US005799491A

United States Patent [19]

Bell et al.

[11] Patent Number: 5,799,491

[45] Date of Patent: Sep. 1, 1998

[54] ARRANGEMENT OF HEAT RESISTANT TILES FOR A GAS TURBINE ENGINE COMBUSTOR

[75] Inventors: Lance P. Bell, Bristol; Neil Gater, Derby; Anthony Pidcock, Derby; Desmond Close, Derby; Simon Cross, Meopham, all of Great Britain

[73] Assignee: Rolls-Royce PLC, London, Great Britain

[21] Appl. No.: 898,278

[22] Filed: Jul. 22, 1997

Related U.S. Application Data

[63] Continuation of Ser. No. 597,991, Feb. 7, 1996, abandoned.

[30] Foreign Application Priority Data

Feb. 23, 1995 [GB] United Kingdom ..... 9503581

[51] Int. Cl.[6] ..... F23R 3/60

[52] U.S. Cl. ..... 60/752; 60/754

[58] Field of Search ..... 60/39.31, 39.32, 60/752, 753, 754

[56] References Cited

U.S. PATENT DOCUMENTS

| | | | |
|---|---|---|---|
| 3,918,255 | 11/1975 | Holden | 60/753 |
| 4,614,082 | 9/1986 | Sterman et al. | 60/752 |
| 5,079,915 | 1/1992 | Veau | 60/753 |
| 5,113,660 | 5/1992 | Able et al. | 60/753 |
| 5,331,816 | 7/1994 | Able et al. | 60/753 |

FOREIGN PATENT DOCUMENTS

| | | |
|---|---|---|
| 397 566 | 11/1990 | European Pat. Off. . |
| 2 179 276 | 3/1987 | United Kingdom . |

*Primary Examiner*—Louis J. Casaregola
*Attorney, Agent, or Firm*—Oliff & Berridge, PLC

[57] ABSTRACT

A plurality of heat resistant tiles are provided which combine to form an internal liner around the walls of an annular combustor. In a first embodiment a plurality of tiles are arranged in an overlapping relationship to form a fully annular shield around an upstream bulkhead wall. In a second embodiment a plurality of tiles are arranged row by row in an overlapping relationship to form a protective shield around the combustors radially spaced sidewalls. In both embodiments the tiles are attached to the combustor in such a manner that at least one edge of the tiles is clamped against the combustor by an overlapping portion of a neighboring tile. The underside of the tile is exposed to a high pressure flow of cooling air which issues as a film over the exposed surface of the tile. The underside of each tile is sealed by virtue of the clamping effect holding the overlapping edges of adjacent tiles in sealing engagement. The arrangement reduces cooling air leakage on the underside of the tiles, minimizes the number of attachment means required per tile and maximizes the tile surface area available for effusion cooling purposes.

15 Claims, 4 Drawing Sheets

ARRANGEMENT OF HEAT RESISTANT TILES FOR A GAS TURBINE ENGINE COMBUSTOR

This is a Continuation of application Ser. No. 08/597,991 filed Feb. 7, 1996 now abandoned.

BACKGROUND OF THE INVENTION

1. Field of the Invention

This invention relates to an arrangement of heat resistant tiles for a gas turbine engine combustor. In particular the invention concerns an arrangement of heat resistant tiles which combine to form an internal liner around the walls of an annular combustor.

Modern gas turbine annular combustors are usually provided with an upstream endwall or bulkhead which extends radially between inner and outer combustor side-wall members to define an upstream plenum and a downstream combustion chamber. The bulkhead is usually provided with a plurality of circumferentially spaced apertures, each of which receives an air/fuel injection device for introducing a mixture of air and fuel into the combustion chamber during engine operation.

In order to protect the bulkhead from combustion temperatures it is often necessary to attach heatshield tiles to the bulkhead structure. In a known arrangement the bulkhead is protected by an annular array of segmented heatshield elements. The segments, which are each associated with one of the air/fuel injection devices, extend both radially towards the inner and outer extents of the bulkhead and circumferentially to abut adjacent segments. The air/fuel injection devices extend into the combustion chamber through corresponding apertures in the heatshield tiles. Each heatshield is spaced apart from the bulkhead so that a narrow cooling passage is defined between the two components. In use cooling air is directed into these passages to cool the bulkhead and heatshield components, and is exhausted through effusion film cooling holes formed in the tile to provide a protective film over the tiles downstream face.

It is important to seal the region around the tile and to this end it has been the practice to provide an upstanding flange on the rear of the tile which sealingly engages the bulkhead structure. It is usually necessary to provide a number of studs on the rear of the tile to hold the tile against the bulkhead wall.

2. Description of the Prior Art

A problem with this approach is that the studs reduce the area available for surface effusion cooling. The studs create discontinuities in the distribution of the surface cooling holes and as such affect cooling efficiency. This is a particular problem when the fuel nozzle apertures occupy a relatively large proportion of the tile, as the remaining tile area is required for both attachment and cooling purposes. This problem arises in so called radially staged combustors where the combustor bulkhead is protected by a pair of radially spaced heatshields. The tile segments which form the inner and outer heatshields are small in comparison with the total bulkhead area. The fuel nozzle apertures occupy a significant area of the tiles leaving relatively little room for the retaining studs.

This problem also arises in combustors which are provided with a plurality of sidewall tiles. These tiles are usually arranged in a contiguous, row by row, manner along the combustor sidewalls. These tiles are spaced in a similar manner from the sidewalls as the bulkhead tiles are from the bulkhead. The sidewall tiles function in an identical manner to the bulkhead tiles, protecting the combustor sidewalls from combustion temperatures.

A further problem associated with sidewall tiles is tile sealing. Typically precision cast tiles are mounted on fabricated frustro-conical combustor wall surfaces. Only rarely is complete sealing achieved along the edges of the tile which engage the combustor wall.

SUMMARY OF THE INVENTION

Accordingly, it is an object of the invention to provide a mounting arrangement for heat resistant tiles which avoids the above drawbacks. In particular it is an object of the invention to provide a mounting arrangement which reduces the number of studs required per tile, maximises the tile surface area available for cooling and reduces cooling air leakage.

According to the invention there is provided an arrangement of heat resistant tiles forming an internal liner of a gas turbine combustor, comprising a plurality of tiles mounted in a contiguous manner on the inner surface of the combustor, each tile being mounted on a wall of the combustor by attachment means on the back of the tile, and whereby at least one edge of a tile is clamped by an overlapping portion of a neighbouring tile.

Preferably at least one edge of a tile is formed with a lip adapted to be clamped under an edge of an overlapping portion of a neighbouring tile.

Preferably the main portion of the tile is spaced from the wall of the combustor and the lip comprises an L-shaped flange along said at least one edge which terminates in a combustor wall contacting portion.

Preferably the overlapping edge of one tile contacts the wall contacting portion of a neighbouring tile. In addition two edges of a tile maybe clamped under the overlapping edges of two neighbouring tiles. Similarly a tile may have two overlapping portions for clamping neighbouring tiles on opposite sides thereof.

In addition effusion means may be provided for promoting an effusion cooling film flow across an exposed face of the tiles, the effusion means may comprise at least one row of cooling holes positioned towards the edge of a tile adjacent to the edge of a neighbouring tile.

BRIEF DESCRIPTION OF THE DRAWINGS

The invention will now be described in greater detail, by way of example only, with reference to the accompanying drawings, in which.

DESCRIPTION OF THE PREFERRED EMBODIMENTS

Figure 1:
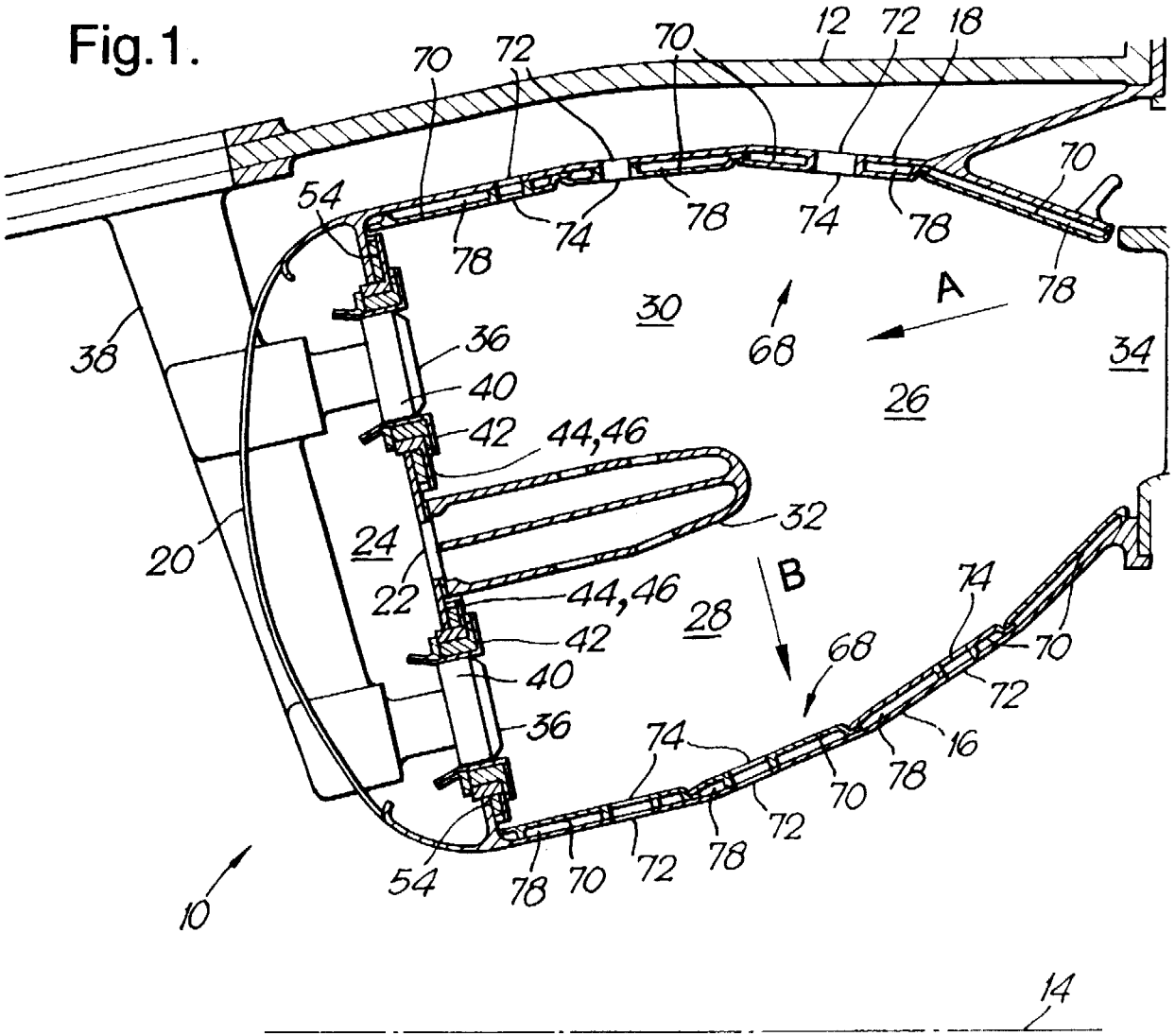
FIG. 1 is a sectioned side view of a gas turbine engine combustor having a heat resistant bulkhead liner and a pair of heat resistant sidewall liners.

Referring now to the drawings, in FIG. 1 there is shown, in side section view, a gas turbine engine annular combustor 10 surrounded by a generally cylindrical section of engine casing 12 which is coaxial with the combustor about the engine's longitudinal axis 14. The remaining engine detail, such as elements of the compressor and turbine which lie adjacent the combustor are omitted for clarity.

The combustor is of generally conventional configuration and comprises a pair of radially spaced inner and outer annular sidewalls walls 16 and 18 which are connected at their upstream ends by means of an aerodynamically shaped combustor head portion 20. The sidewalls are further connected by means of an annular bulkhead 22 which extends between the sidewalls 16 and 18 to provide an upstream air entry plenum 24 and a downstream combustion chamber region 26. The combustor shown is of the type configured for low emission staged operation and includes both inner and outer radial combustion zones, 28 and 30 respectively. The inner and outer zones 28 and 30 are separated by means of an annular centre body 32 which extends in a generally axial direction from the annular bulkhead structure 22 towards the combustor exit 34.

In use air from an upstream compressor (not shown, but to the left of the drawing) enters the plenum chamber 24 through a plurality of inlet apertures formed in the domed shaped head 20, and exits the plenum through a plurality of air spray type fuel delivery nozzles 36 suspended from the engine casing 12. The nozzles 36 are mounted in pairs on radially extending fuel delivery arms 38 which are circumferentially spaced around the combustor head 20 for even distribution. The nozzles are positioned in corresponding fuel nozzle apertures 40 formed in the combustor bulkhead for discharge to the combustion chamber during operation.

An annular seal 42 is positioned between each of the nozzles 36 and the bulkhead apertures 40 to prevent leakage of high pressure combustion air. The seals are slidably mounted with respect to the bulkhead to allow limited radial and axial movement of the nozzles 36 relative to the bulkhead structure. This mounting arrangement provides for unrestrained thermal expansion of the combustor relative to the fuel supply nozzles 36, and as such prevents any unnecessary loading of the components due to differential thermal expansion.

Figure 2A:
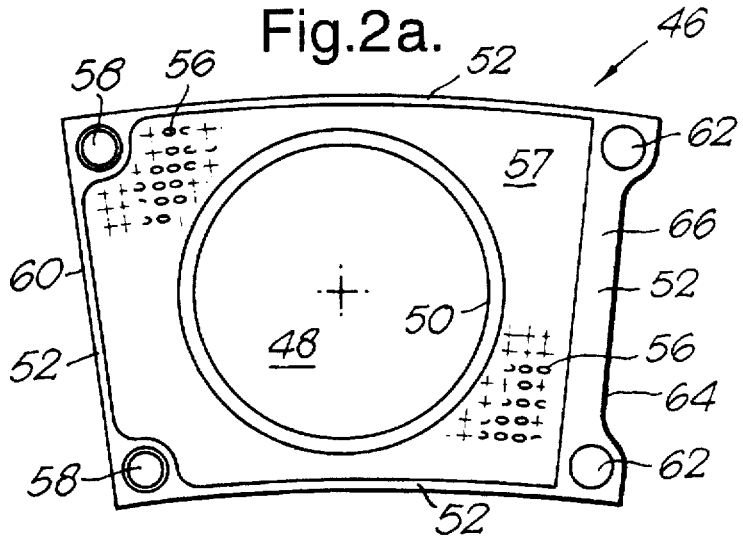
FIG. 2*a* is the back side of an end view in the direction of arrow A of a heat resistant tile according to a first embodiment of the invention.
Figure 2B:
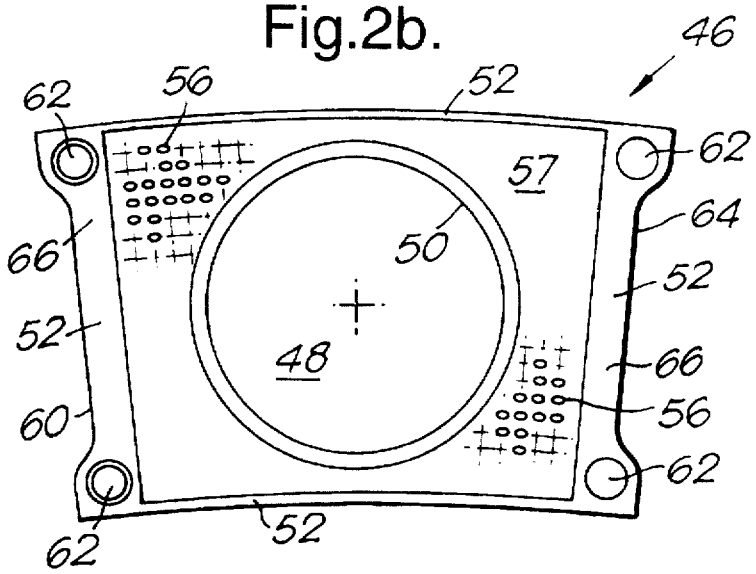
FIG. 2*b* is an end view of a heat resistant tile similar to that of FIG. 2*a*, but constructed in accordance with an alternative tile arrangement.
Figure 2C:
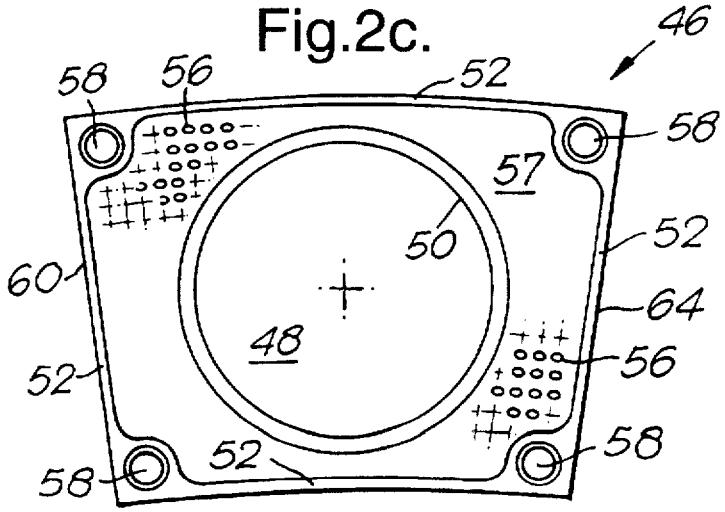
FIG. 2*c* is an end view of a heat resistant tile similar to that also of FIG. 2*a*.

A pair of radially spaced protective heatshield liners 44 are mounted on the downstream face of the bulkhead 22 to provide thermal shielding from combustion temperatures. Each of the heatshields 44 has an annular configuration made up of a plurality of abutting heatshield or tile segments 46. The segments, which are of substantially identical form, extend both radially towards the centre body 32 and a respective one of the combustor walls 16 and 18, and circumferentially towards adjacent segments to define a fully annular shield. Some or all of the segments may be provided with a fuel nozzle aperture 48 for receiving a fuel supply nozzle 36. The tile segments shown in FIGS. 2*a*, 2*b* and 2*c* are provided with a single fuel nozzle aperture which is surrounded by an annular flange 50. As shown, the bulkhead and heatshield apertures 40 and 48 are aligned such that they accommodate the fuel nozzle 36 and nozzle seal 42.

The tile segments 46 are each spaced a short distance from the bulkhead by flanges 52 integrally formed on the upstream face of the segments. As illustrated in FIGS. 2*a*, 2*b* and 2*c* the flanges are formed around the edges of the tiles so that they define an enclosed chamber 54 between the tile and combustor bulkhead. A plurality of apertures (not shown) are formed in the bulkhead immediately behind the tiles for the passage of cooling air from the plenum 24 to the chambers 54. There may be as many of these apertures as necessary to provide an even distribution of cooling air to the rear face of the tiles.

The cooling air exits the chambers 54 through a plurality of film cooling holes 56. These cooling holes are formed in the region 57 between the side edge flanges 52 and the central nozzle assembly flange 50.

In accordance with the invention the tile segments are secured to the bulkhead by studs 58 integrally formed on the upstream face of some or all of the tiles. The tiles are held in place by lock nuts (not shown) which clamp the side edge flanges 52 into sealing engagement with the bulkhead. The flanges 52 seal the chamber perimeter to prevent cooling air leakage. The cooling air entering the chambers 54 is thus constrained to exit, as a protective film, over the downstream face of the tiles, through the film cooling holes 56.

Figure 3A:
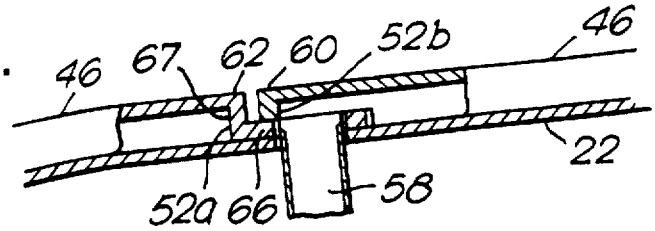
FIG. 3*a* is a part section part cut-away view of the bulkhead liner illustrating the joint connection between adjacent FIG. 2*a* tiles.

The tile segment illustrated in FIG. 2a includes a pair of integral studs 58 positioned at opposite ends of it's radial side edge 60. The tile also includes a pair of stud receiving apertures 62 at corresponding positions on it's opposing radial side edge 64. As is indicated in FIG. 3*a* the apertures 62 are adapted to receive the studs of an overlapping side edge 60 of a neighbouring tile. In FIG. 3*a* the side edges 60 and 64 of neighbouring tiles are overlapped to form a near continuous shield around the combustor bulkhead wall 22.

As can be determined from FIG. 3*a*, each tile segment has an L-shaped flange **52*a* running along it's side edge 64. The flange defines a wall contacting portion 66 at it's distal end and an adjoining wall portion 67 at it's proximal end. The stud receiving apertures are formed in the wall contacting portion of the flange so that at each joint location the studs of a one tile clamp the wall contacting portion of another against the bulkhead wall 22. As shown, the opposing flange 52*b* is cut-back in the region of the joint to accommodate the wall contacting portion of it's neighbour. The flange 52*b* is cut back by an amount equal to the thickness of the wall contacting portion 66 so that at each joint location the overlapping flanges of are held in sealing engagement by the studs 58**.

The overlapping arrangement described effectively halves the number of retaining studs required. The design enables the studs of one tile to be used to secure the side edge of another without reducing clamping efficiency. The arrangement thus provides for a more lightweight combustor module. The invention also reduces the tile area required for fixing. By overlapping the fixing points in the manner described a greater area of the tile can be utilised for cooling purposes. Because a greater area of the tile is available additional film cooling holes can be formed and a more evenly distributed film achieved. Improved cooling efficiency is also obtained because the number of potential hot spots, due to cooling hole discontinuities at the stud locations, is reduced.

As an alternative to the arrangement so far described, the tiles shown in FIGS. 2*b* and 2*c* may also be used to form a heat resistant liner in accordance with the invention. The tiles shown in these drawings are similar to the tile shown in FIG. 2*a*, but differ in some material respects. Where appropriate the same reference numerals are used to for the same parts.

Figure 3B:
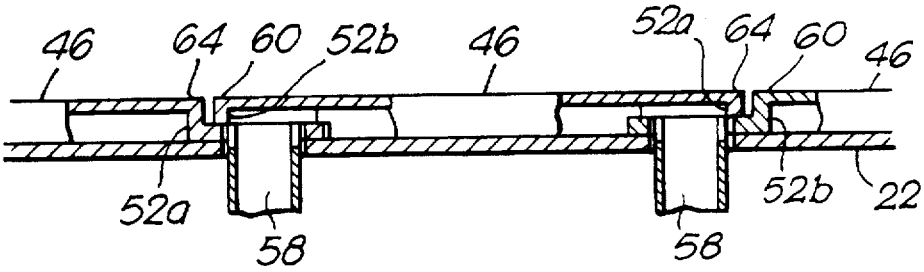
FIG. 3*b* is a part section part cut-away view of an alternative bulkhead liner showing the joint connection between adjacent FIGS. 2*b* and 2*c* tiles.

The tile shown in FIG. 2*b* is substantially identical to that of FIG. 2*a*. The tile differs only in the respect that it's radial side edges 60 and 64 are identical. Both the side edges correspond to the apertured side edge 64 of the FIG. 2*a* tile. In a similar manner the side edges 60 and 64 of the tile of FIG. 2*c* are identical and correspond to the studded edge 60 of the FIG. 2*a* tile. The tiles of FIGS. 2*b* and 2*c* permit the construction of a heatshield liner in accordance with the arrangement shown in FIG. 3*b*. As shown, the tiles form an overlapping joint, which is identical to that shown in FIG. 3*a*. The FIG. 2*b* tiles are interdigitated with the tiles of FIG. 2*c* to form a continuous liner. The arrangement is such that both the side edges of the FIG. 2*b* tiles are clamped under the overlapping side edges of the neighbouring FIG. 2*c* tiles. As will be appreciated this arrangement provides all the benefits of the invention, and in addition permits replacement of individual tiles.

Referring back to FIG. 1, the inner and outer combustor walls are each provided with an internal heat resistant liner 68 made up of a plurality of heat resistant tile segments 70. The tile segments 70 are arranged row by row, in a contiguous manner, on each of the internal wall surfaces. The inner and outer liners each comprise four rows of similar, but not identical, tile segments 70 which extend circumferentially to form a fully annular heat-resistant liner between the bulkhead 22 and exit 34.

As shown, the combustor walls 16 and 18 are formed with a plurality of distributed apertures 72 for air entry into inner and outer combustion zones 28 and 30. This air which supports the combustion process is ducted from the compressor outlet and enters the combustion chamber 26 at a higher pressure than the combustion gases. To this end some or all of the tile segments are provided with combustion air entry apertures 74 which are disposed within the tiles such that they align with the combustor wall apertures 72 when assembled.

The tiles are spaced a short distance from the combustor walls by flanges integrally formed on the underside of the tiles. As can best be seen in FIG. 4, each tile includes a pair of circumferentially spaced side edge flanges 76*a* and 76*b*, and a pair of axially spaced side edge flanges 76*c* and 76*d*. The flanges are formed around the side edges so that they define an enclosed cavity 78 between the tile and combustor wall. The combustors walls 16 and 18 are apertured in the region of the cavities 78 for the supply of cooling air for tile cooling purposes. The tiles are also apertured in the sense that they are provided with a series of film cooling holes for discharge of the cooling air over the exposed face of the tile. The detailed nature of the film cooling holes is a separate aspect of the invention and is discussed more fully later in the description.

Figure 4:
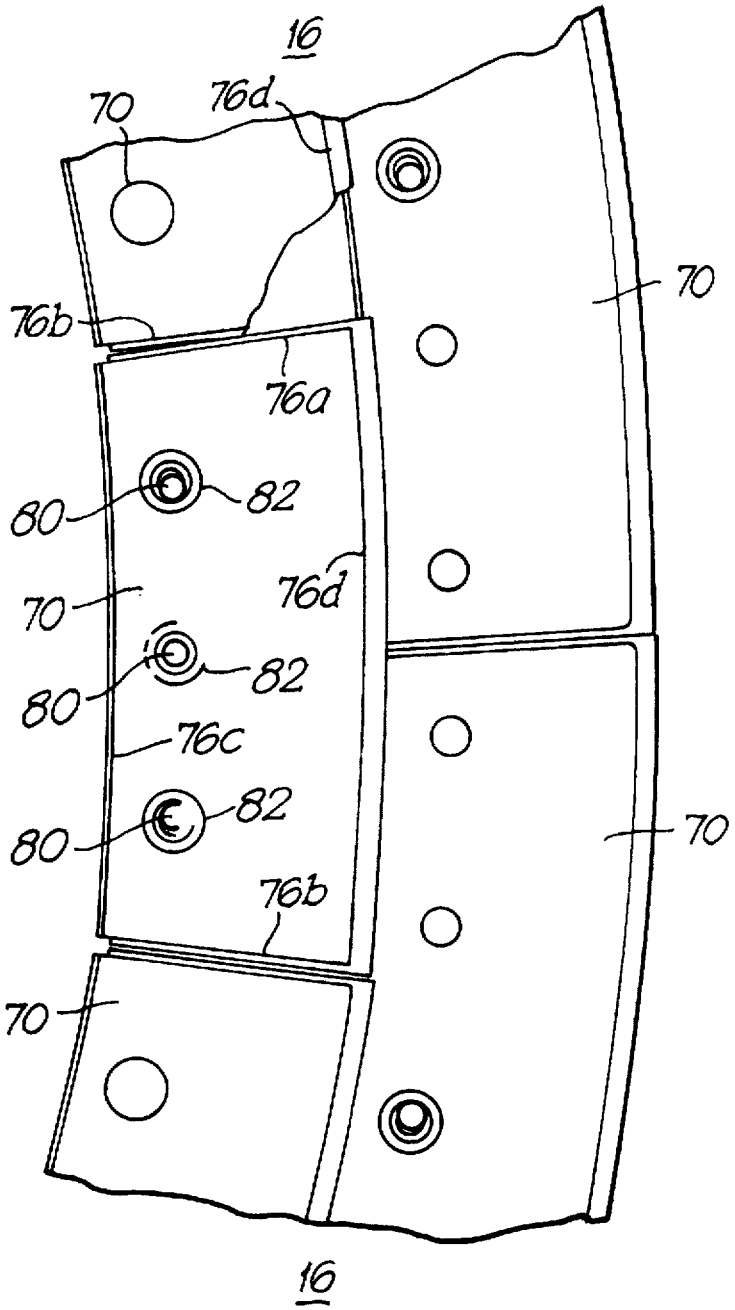
FIG. 4 is a part cut-away view of the combustor of FIG. 1, in the direction of arrow B, revealing a heat resistant liner according to a second embodiment of the invention.

The tiles are secured to the combustor walls by retaining studs 80 formed on the rear face of the tiles. As FIG. 4 illustrates, each tile is provided with three such retaining studs 80. The studs are mounted in bosses 82 on the underside of the tile in the region enclosed by the side edge flanges 76*a*–76*d*. The studs are circumferentially spaced between the side edge flanges 76*a* and 76*b* and offset axially towards the upstream flange 76*c*. The offset nature of the studs provides for increased clamping at the upstream edge of tile.

Figure 5A:
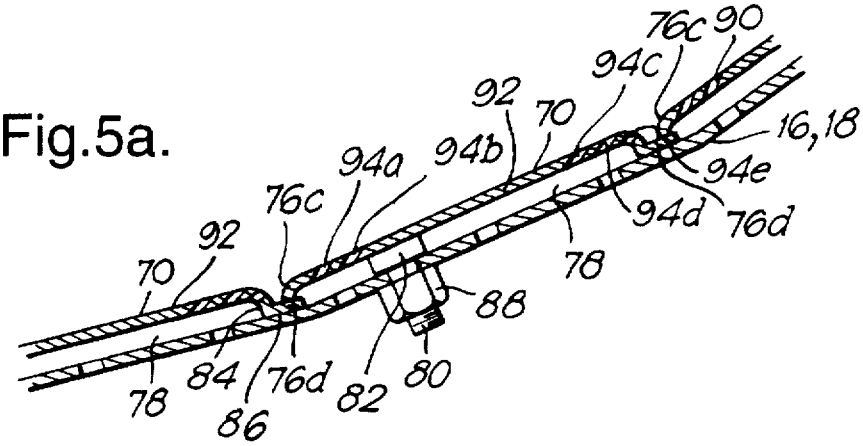
FIG. 5*a* shows part of the combustor of FIG. 1, in the region of the radially inner sidewall, in greater detail.

With reference now to FIG. 5*a*, the upstream flange 76*c* of each tile 70 is shaped to clamp the downstream flange 76*d* of an adjacent tile in the liner assembly. The upstream flange is shaped such that it defines an inwardly facing lip at the upstream edge of the tile. The downstream flange has a generally L-shaped configuration which defines an inwardly extending portion 84 and a wall contacting portion 86. The upstream flange of one tile engages the the wall contacting portion 86 of neighbouring tile to form a sealed joint. The whole assembly is held together by the lock nuts 68 which hold the overlapping portions in sealing engagement to prevent cooling air leakage from the tile cavities 78.

The overlapping arrangement described provides for improved sealing in the sense that it minimises the number of potential leakage paths between the tile cavities 78 and the combustion chamber 26. Any leakage due to incomplete sealing between the downstream flange 76*d* and the combustor wall will not be lost. Cooling air that is lost from one cavity in this sense will flow into the adjacent cavity on the underside of the neighbouring tile. A potential leakage path remains between the overlapping flanges of adjacent tiles, but this may be controlled by accurate manufacture of the mating tile surfaces.

Figure 5B:
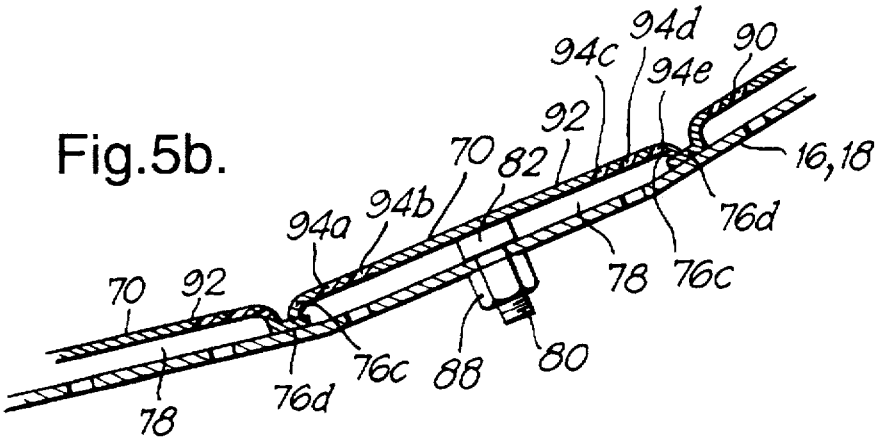
FIG. 5*b* shows the same part of the combustor as FIG. 5*a*, but with an alternative arrangement of heat resistant tiles.

In the alternative arrangement of FIG. 5*b*, each row of tiles is different from it's neighbour. Alternate rows of tiles are arranged such that the tiles of a one row clamp the overlapping portions of the tiles of the adjoining rows. In FIG. 5*b*, the tiles are constructed such that they have an upstream flange and a downstream flange of substantially identical configuration. In one of the alternate rows the the flanges are constructed in accordance with the upstream flange 76*c* of the FIG. 5*a* tiles, and in the other in accordance with the downstream flange 76*d*. This arrangement permits replacement of individual tiles in much the same way as the tiles of FIGS. 2*b* and 2*c*.

In accordance with a further aspect of the invention the combustor wall tiles shown in FIGS. 5*a* and 5*b* are each provided with a plurality of effusion film cooling holes 90 for promoting an effusion film cooling flow across the exposed face 92 of the tiles. In both arrangements the holes are arranged in rows positioned towards the upstream and downstream edges of the tile. The holes are angled with respect to the tile so that they promote a flow of film cooling air in the downstream direction of the tile, to the right of the drawing in FIGS. 5*a* and 5*b*.

The tiles of FIG. 5*a* are provided with two rows of circumferentially spaced cooling holes 94*a* and 94*b* at their upstream end, and three rows 94*c*, 94*d* and 94*e* at their downstream end. The upstream rows 94*a*, 94*b* are spaced a short distance from the upstream flange 76*c* for maximum cooling effect. Two of the downstream rows 94*c* and 94*d* are similarly spaced from the downstream flange 76*d*, but the third row 76*e* is formed in the inwardly facing portion 84 of the flange. The cooling holes which define the two upstream and two downstream rows 94*a*–*d* are inclined with respect to the tile surface by substantially equal amounts. Preferably these rows are angled 25 degrees to the tile surface 92, but other angles may be selected if desired. The tiles forming the final row of cooling holes have a shallower angle. In the example shown the holes in row 94*e* are formed at 15 degrees to the tile surface 92. This angle is determined by the shape of the adjoining side edge. The angle is such that the holes promote a parallel flow of effusion film cooling air over the upstream edge of the neighbouring tile. This flow ensures that there is a continuous film of cooling air between adjacent tiles, and also between the forward extremity and first row of cooling holes 94*a* of the tiles. The cooling holes of the final row 94*e* are positioned towards the proximal end of the downstream flange 76*d* so that the exiting flow protects the uncooled surface of the neighbouring tile. Preferably this region tapers towards the adjoining upstream tile, and preferably by an amount equal to the angle of the final row of cooling holes. The taper assists the formation of a film over the joint and the uncooled tile surface forward of the first cooling hole row 94*a*.

In the alternative arrangement of FIG. 5*b* it will be seen that the tiles which comprise upstream and downstream flanges according to the 76*c* flange configuration are provided with a similar distribution of effusion cooling holes. Each tile comprises two upstream 94*a*, 94*b* and three downstream rows 94*c–e*, all of which are inclined to the film surface 92, all by similar amounts.

The downstream edges of the tiles positioned in the adjacent rows are provided with three rows of cooling holes as in FIG. 5*a*, and upstream edges two rows downstream of the flange 76*d*.

We claim:

1. An arrangement of heat resistant tiles forming an internal liner of a gas turbine combustor, comprising a plurality of tiles mounted in a contiguous manner on an inner surface of the combustor, each of the plurality of tiles being mounted on a wall of the combustor by attachment means on a back surface of each of the plurality of tiles and at least one edge of each of the plurality of tiles being provided with one of a lip and an overlapping portion, a first one of the plurality of tiles having a lip being contactedly clamped to the wall by an overlapping portion of a neighbouring one of the plurality of tiles, and an enclosed chamber being provided between each of the plurality of tiles and the wall of the combustor.

2. An arrangement of heat resistant tiles according to claim 1 wherein a main portion of the first one of the plurality of tiles is spaced from the wall of the combustor and the lip comprises an L-shaped flange along said at least one edge which terminates in a combustor wall contacting portion.

3. An arrangement of heat resistant tiles according to claim 2 wherein the overlapping portion of the neighbouring one of the plurality of tiles contacts the combustor wall contacting portion of the first one of the plurality of tiles.

4. An arrangement of heat resistant tiles according to claim 1 wherein two edges of a second one of the plurality of tiles are lips clamped to the wall under overlapping edges of third and fourth ones of the plurality of tiles adjacent the second one of the plurality of tiles.

5. An arrangement of heat resistant tiles according to claim 1 wherein a second one of the plurality of tiles has two overlapping portions for clamping third and fourth ones of the plurality of tiles, the third and fourth ones of the plurality of tiles being located on opposite sides of the second one of the plurality of tiles.

6. An arrangement of heat resistant tiles according to claim 1 wherein the plurality of tiles is mounted on a downstream face of a combustor bulkhead wall.

7. An arrangement of heat resistant tiles according to claim 1 wherein the plurality of tiles is mounted on combustor sidewall surfaces.

8. An arrangement of heat resistant tiles according to claim 1 wherein effusion means are provided for promoting an effusion cooling film flow across an exposed face of at least one of the plurality of tiles, the effusion means comprising at least one row of effusion holes positioned towards an edge of a second one of the plurality of tiles adjacent to an edge of a third one of the plurality of tiles neighbouring the second one of the plurality of tiles.

9. An arrangement of heat resistant tiles according to claim 8 wherein the at least one row of effusion holes is formed towards a downstream edge of the second one of the plurality of tiles.

10. An arrangement of heat resistant tiles according to claim 9 wherein there is at least one further row of effusion holes formed towards an upstream edge of the second one of the plurality of tiles.

11. An arrangement of heat resistant tiles according to claim 10 wherein the effusion holes are angled relative to an exposed surface of the second one of the plurality of tiles.

12. An arrangement of heat resistant tiles according to claim 11 wherein the effusion holes are angled in a downstream direction.

13. An arrangement of heat resistant tiles according to claim 12 wherein a final row of effusion holes positioned towards the downstream edge of the second one of the plurality of tiles is adapted to promote a film of cooling air across an upstream edge of the third one of the plurality of tiles.

14. An arrangement of heat resistant tiles forming an internal liner of a gas turbine combustor, comprising a plurality of tiles mounted in a contiguous manner on an inner surface of the combustor, each of the plurality of tiles being mounted on a wall of the combustor by attachment means on a back surface of each of the plurality of tiles and at least one edge of each of the plurality of tiles being provided with one of a lip and an overlapping portion, a first one of the plurality of tiles having the lip being clamped to the wall by an edge of the overlapping portion of a neighbouring one of the plurality of tiles, and an enclosed chamber being provided between each of the plurality of tiles and the wall of the combustor, wherein a main portion of the first one of the plurality of tiles is spaced from the wall of the combustor and the lip comprises an L-shaped flange along said at least one edge which terminates in a combustor wall contacting portion.

15. An arrangement of heat resistant tiles forming an internal liner of a gas turbine combustor, comprising a plurality of tiles mounted in a contiguous manner on a downstream face of a combustor bulkhead wall of the combustor, each of the plurality of tiles being mounted on the combustor bulkhead wall by attachment means on a back surface of each of the plurality of tiles and at least one edge of each of the plurality of tiles being provided with one of a lip and an overlapping portion, a first one of the plurality of tiles having the lip being clamped to the wall by an edge of the overlapping portion of a neighbouring one of the plurality of tiles, and an enclosed chamber being provided between each of the plurality of tiles and the combustor bulkhead wall.

* * * * *